US005591534A

United States Patent [19]

Vigeant et al.

[11] Patent Number: 5,591,534

[45] Date of Patent: Jan. 7, 1997

[54] ENHANCED PROTECTIVE METALLIC COATING WEIGHTS FOR STEEL SHEET

[75] Inventors: Andre F. Vigeant, Cornwall; Alain Bernard, Contrecoeur, both of Canada

[73] Assignee: Sorevco, Inc., Coteau-du-Lac, Canada

[21] Appl. No.: 218,069

[22] Filed: Mar. 25, 1994

[51] Int. Cl.[6] ..... B32B 15/18

[52] U.S. Cl. ..... 428/612; 428/653; 428/659; 428/687; 428/939

[58] Field of Search ..... 428/609, 612, 428/653, 659, 687, 939

[56] References Cited

U.S. PATENT DOCUMENTS

| | | | |
|---|---|---|---|
| 1,902,621 | 3/1933 | Davis et al. | 428/612 |
| 1,960,958 | 5/1934 | Sargent | 428/687 |
| 2,221,890 | 11/1940 | Williams | 428/687 |
| 3,150,940 | 9/1964 | Graves | 428/687 |
| 3,314,684 | 4/1967 | Millhiser | 428/687 |
| 3,619,247 | 11/1971 | Newport | 428/612 |
| 4,071,657 | 1/1978 | Rault | 428/687 |
| 4,775,599 | 10/1988 | Matsuoka et al. | 428/687 |
| 4,798,772 | 1/1989 | Furukawa | 428/687 |
| 4,959,275 | 9/1990 | Iguchi et al. | 428/687 |
| 5,141,781 | 8/1992 | Suzuki et al. | 427/398.1 |
| 5,324,594 | 6/1994 | Yasuda et al. | 428/659 |

FOREIGN PATENT DOCUMENTS

| | | |
|---|---|---|
| 2640596 | 6/1990 | France . |
| 59-104201 | 6/1984 | Japan . |
| 64-47842 | 2/1989 | Japan . |
| 1-263253 | 10/1989 | Japan . |
| 2-175004 | 7/1990 | Japan . |
| 1296245 | 3/1987 | U.S.S.R. . |

*Primary Examiner*—John Zimmerman

*Attorney, Agent, or Firm*—Lee, Mann, Smith, McWilliams, Sweeney & Ohlson

[57] ABSTRACT

A galvanized steel sheet has a coating layer of protective material applied to its surface where the steel sheet has been roughened prior to application of the protective material. The improvement is characterized by the roughened steel surface having a pattern which ensures desired consistent quantity of coating during application of the protective material. The pattern provided on the sheet surface has a multitude of depressions defined by a plurality of ridges. The upper surfaces of the ridges defining a plane for each side of the steel sheet, where the ridges have a surface area less than ¼ the nominal surface area of the sheet side. Each depression has a depth defined by a continuous side wall extending into the plane of the sheet side. The side wall slopes downwardly of the plane at an angle greater than 45°. The multitude of depressions on the sheet side picks up a sufficient quantity of coating material to provide the desired consistent quantity of coating on the sheet surface when solidified and adhered thereto. This improvement in the pattern on the sheet side can increase the amount of protective material provided by 2 to 3 times what can be realized with existing roughened surfaces of steel sheet prepared for galvanizing.

29 Claims, 2 Drawing Sheets

ENHANCED PROTECTIVE METALLIC COATING WEIGHTS FOR STEEL SHEET

FIELD OF THE INVENTION

This invention relates to steel sheet and more particularly surface patterns which significantly increase the amount of protective metallic coating material applied to the sheet surface.

BACKGROUND OF THE INVENTION

Steel sheet is used in a variety of applications which if unprotected leads to rapid corrosion and resultant loss in structural strength. The most common technique to protect steel sheet from corrosion is to coat the steel sheet with a metallic protective coating such as galvanized, galvalume or aluminized coating. The protective material is commonly applied to steel sheet by a hot dip process, painting or electroplating. Electroplating of zinc protective material to a steel sheet is useful when precise amounts of galvanize coating material is to be applied to complex surface configurations. However, such process is energy intensive and hence, expensive compared to the hot dip application process which is satisfactory for use in coating most types of flat sheet. In some instances the flat sheet is formed into the product for use such as animal drinking troughs, small culvert, auger chutes and the like. They are dipped directly in a hot tank of, galvanized material and removed to achieve a coating of galvanized material on the article. However, the thickness of the galvanized material can vary considerably across the surface of the article.

Exemplary of normal coating methods, sheet galvanizing is usually carried out in a hot dip bath where the sheet passes downwardly into the bath and then is drawn upwardly out of the bath in a vertical manner. The excess galvanized material which adheres to the sheet is removed by the use of high velocity air or nitrogen jets to provide the desired coating thickness on the galvanized sheet. In this way, all surfaces of the sheet are covered galvanized material. Usually special edge treatment is required because of the inherent processing problem that excess protective material, such as galvanize, builds up on the edges of the sheet. Such edge build up greatly detracts from its use in forming-various articles and hence requires removal before forming of the sheet into the article or as already noted, requires special edge treatment while the sheet is being removed from the hot dip tank.

It is normal to roughen the surface of the steel sheet in order to increase the quantity of protective metallic material adhered to the steel surface. As is appreciated, the zinc in the galvanized or the aluminum in the galvalume or aluminized material reacts with the iron in the steel sheet to form zinc-iron alloy and/or an aluminum iron alloy at the interface between the protective material and the steel sheet. Such alloy then adheres or bonds the solidified coating material to the steel sheet.

The usual technique for roughening the steel sheet is to use a surface finishing roller which has a rough surface provided thereon. The roller provides for the last pass once the sheet has been rolled to the desired thickness. During the last pass the roughened pattern on the roller is transferred to the steel sheet. The most common technique for roughening the surface of the roller in order to transfer a roughened pattern to the steel sheet is to expose the steel roller to shot blast. Various size grits of particles are used to obtain the desired surface roughness on the rollers. Such surface roughness is in the form of jagged peaks which transfer the corresponding image to the surface of the steel sheet to provide a roughened surface with several peaks and valleys. Due to the sharpness of the ridges on the rollers they tend to wear quickly resulting in an inferior roughened surface on the steel sheet and also requiring rejuvenation of the steel rollers by shot blasting.

This type of roughened surface has resulted in inconsistencies in coating weight of protective metallic material applied to the sheet surface. Such variation in the coating weight requires that the coated sheet material be downgraded for purposes of sale thereby resulting in significant loss of revenue. The downgraded reject material becomes more and more of problem as coating plants attempt to apply greater quantities of coating material to the surface of the sheets. For example, with existing processes, total sheet coating weights in the range of 600 to 700 g/m$^2$, can result in up to 20 to 25% reject material due to inconsistency in coating thicknesses.

There continues however to be a significant demand for heavy coated steel sheet to provide greater corrosion resistance, and longer life. However, with existing processes such material is expensive to produce.

Most attempts at providing maximum surface roughness in the rolled steel sheet has resulted in failure in attempting to exceed galvanized or other metal coating quantities of approximately 600 to 700 g/m$^2$. Usually the surface roughness required in the steel rolls is so severe that the sharp ridges on the roll wear very quickly and therefore exceed their usefulness in applying a roughened surface to the steel sheet.

Various techniques for surface roughening which do not necessitate rapid replacement of the steel rolls are described, for example, in Russian Patent SU 1,296,245. The work rolls provide a surface roughness of a depth of approximately 3.7 microns. Greater surface roughness which is achieved by blast treating the surface, for example with galvanized steel pipe, is described in Japanese published application 01/047,842 published Feb. 22, 1989. The blasted steel pipe has a surface roughness in the range of 20 to 80 microns before the galvanized material is applied.

Satin-finished surfaces, which provide a degree of roughened surface by virtue of a skin pass roll on the steel sheet is described in published Japanese application 59/104201 published Jun. 16, 1984. The satin finish provides a roughened surface on the steel sheet which has several peaks and regular corrugation to improve adhesion of the galvanized material to the steel sheet. Other types of skin pass rolling to achieve a surface roughness is described in published Japanese application 02/175,004 published Jul. 6, 1990. The skin pass rolling is achieved using rolls having pitted surfaces formed by laser dulling processing.

None of these processes however are capable of applying on a consistent basis, galvanized or other protective metallic coatings of a double-sided coating in excess of 600 g/m$^2$. We have discovered that by forming a special pattern in the surface of the steel sheet a significant benefit in the amount of protective metallic coating can surprisingly be achieved.

SUMMARY OF THE INVENTION

In a hot dip coated steel sheet product having a protective coating layer of a protective metallic material selected from the group consisting of galvanized material, galvalume material and aluminized material, the protective material being applied over its entire surface, the steel sheet being roughened on at least one side prior to hot dip application of protective material thereto, the protective material during the hot dip application reacting with the steel sheet to form a steel alloy which adheres the layer of protective material to the steel sheet.

According to an aspect of the invention, the improvement is characterized by the roughened steel surface having a pattern which ensures desired consistent quantity of the protective coating during application of the protective material, the pattern providing on the side a multitude of depressions defined by plurality of ridges, the upper surfaces of essentially all of the ridges for the side defining a plane for the side, the upper surfaces of the ridges having a surface area less than one quarter the nominal surface area of the side, each depression having a depth defined by a sidewall extending into the plane of the side, the sidewall sloping inwardly of the side plane at an angle greater than 45°, the multitude of depressions on the side picking up a sufficient quantity of the protective material to provide the desired consistent quantity of the protective material when solidified and adhered to the side of the steel sheet.

In accordance with another aspect of the invention, a steel sheet having a surface pattern on at least one side for ensuring a desired consistent quantity of protective metallic coating material by hot dip application of the protective material, the pattern providing on the side a multitude of depressions defined by a plurality of ridges, the upper surfaces of essentially all of the ridges for the side defining a plane for the sheet side, the ridges having a surface area less than one quarter the nominal surface area of the side, each depression having a depth defined by a sidewall extending into the plane of the side, the sidewall sloping inwardly of the side plane at an angle greater than 45°, the multitude of depressions on the side picking up a sufficient quantity of the protective material to provide the desired consistent quantity of the protective material when solidified and adhered to the side of the steel sheet.

In accordance with a further aspect of the invention, a method for coating a steel sheet with a continuous layer of protective metallic material on both sides of and on shoulders and edges of the sheet, the method comprises:

passing the sheet through a hot dip coating bath and removing the sheet vertically from the bath with protective metallic material adhered to sides and edges/shoulders of the sheet, the protective material being selected from the group consisting of galvanized material, galvalume material and aluminized material, controlling thickness of adhered protective material on the sheet by use of air knives for blowing excess galvanized material back down into the tank and providing thereby a desired quantity of coating on the sheet, the improvement comprises the use of a sheet having a surface pattern on at least one side of the sheet for ensuring desired consistent quantity of the protective coating on that patterned side, the pattern providing on the side a multitude of depressions defined by plurality of ridges, the upper surfaces of essentially all of the ridges for the side defining a plane for the sheet side, the ridges having a surface area less than one quarter the nominal surface area of the side, each depression having a depth defined by a sidewall extending into the plane of the side, the sidewall sloping inwardly of the side plane at an angle greater than 45°, the multitude of depressions on the side of the sheet picking up a sufficient thickness of protective material to provide the desired consistent quantity of the protective material when solidified and adhered to the side of the steel sheet, whereby the surface pattern ensures a desired quantity of protective coating.

BRIEF DESCRIPTION OF THE DRAWINGS

Preferred embodiments of the invention are described with respect to the drawings wherein.

DETAILED DESCRIPTION OF THE PREFERRED EMBODIMENTS

It is appreciated that there are three common forms of protective coating materials. These are commonly known as galvanize, galvalume and aluminize materials. In order to facilitate discussion of various embodiments of the sheet surface pattern, reference is made to galvanize material, although it is appreciated that the various aspects of the invention apply to any form of metallic protective coating.

Galvanized material which normally consists of zinc, aluminum and other trace components is commonly applied to a variety of steel products to protect the steel from corrosion. The zinc as provided on the surface cathodically protects the steel as long as the zinc remains active. Hence, when the galvanized material is exposed to a corrosive environment the zinc is preferentially oxidized to zinc oxide instead of oxidizing the steel. As is generally understood, zinc, as present on the surface of steel can protect any exposed steel which may be approximately within ⅛ of an inch (2.5 to 3 mm) from the zinc. The galvanized material may be applied to steel surfaces by hot dip application, spray coating, electrodeposition and the like. Spray coating and electrodeposition are used in applying thin layers of galvanized material to complex shapes. When it comes to coating steel sheet the preferred process of application is hot dip application where the sheet normally unrolled is passed through a molten tank of galvanized material and drawn upwardly therefrom with the galvanized material adhered thereto.

Figure 1:
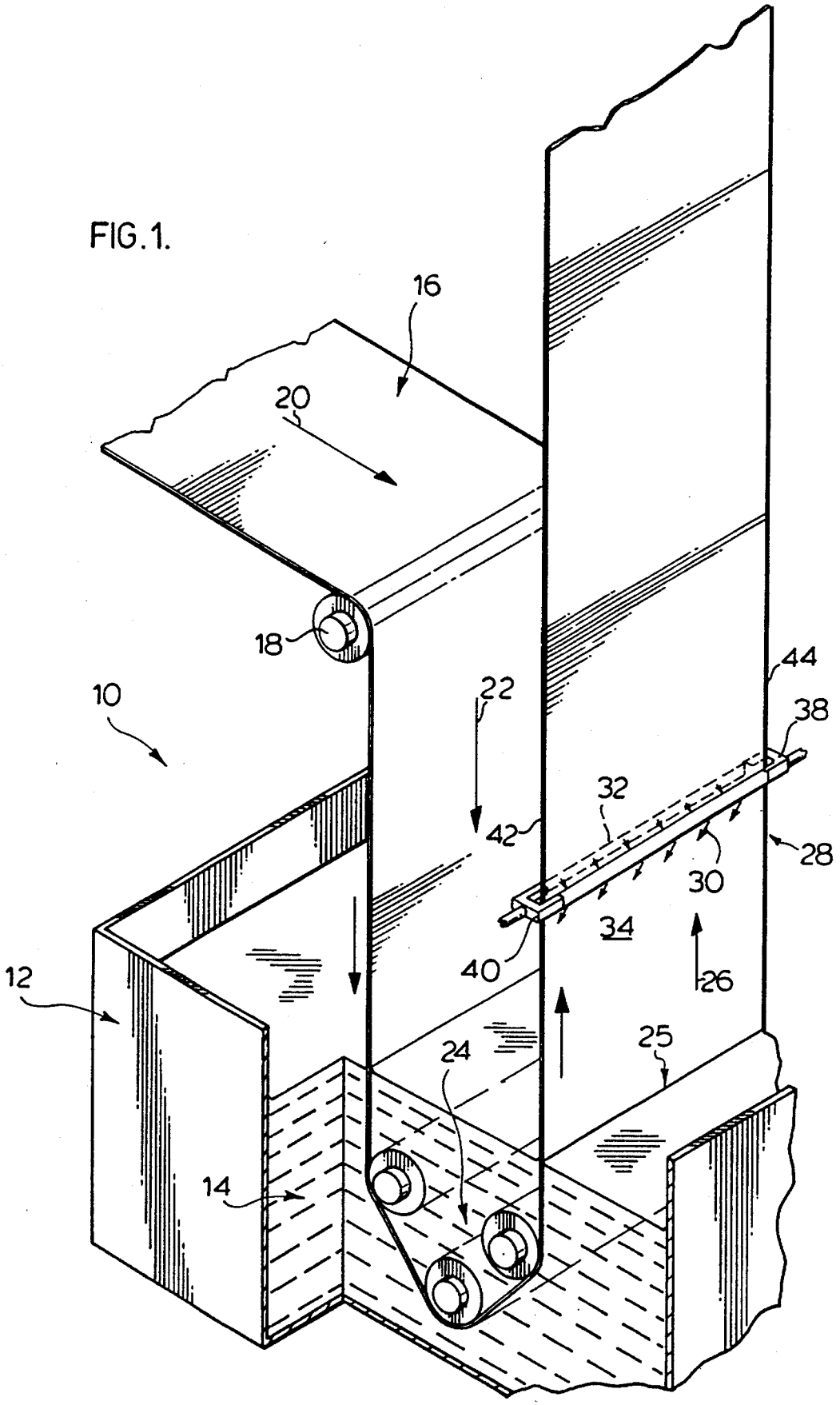
FIG. 1 is a partial view in perspective of a hot dip galvanizing system.

As shown in FIG. 1, a representative form of hot dip application for galvanized material to steel sheet is shown. The hot dip galvanizing system 10 comprises a tank 12 filled with molten galvanized material 14. Galvanized material, as noted, consists normally of zinc, aluminum and other trace metals such as antimony. In accordance with normal galvanized processing lines, the sheet 16 as removed from the roll passes through a metering and surface quality assessment device. At the same location a welding device may be provided for welding ends of sheet together so as to provide a continuous sheet for travel through the system. Accumulators are provided for accumulating considerable length of sheet to ensure that the sheet runs continuously through the galvanized hot dip bath while, for example, the end of a new sheet is being attached to the end of the existing sheet of the machine. The sheet is heated to remove contaminants and as well heat treated at elevated temperatures to prepare the sheet for hot dip application. The heated sheet in accordance with the schematic of FIG. 1 passes in direction of arrow 20 over roller 18 and downwardly in the direction of arrow 22 underneath roller system 24. The level 25 of the galvanized material 14 in bath 12 is above roller system 24 so that the sheet 16 in moving downwardly in the direction of arrow 22 is immersed in the high temperature bath to commence the reaction at a bath temperature of 875° F., of the zinc with the iron to form a zinc-iron alloy at the interface. The sheet moves upwardly in the direction of arrow 26 and outwardly of the bath 14 with galvanized material adhered thereto. An air-knife device 28 is provided to blow a thin stream of air downwardly in the direction of arrows 30 and 32 against each side of the coated sheet 34. The sheet continues upwardly through the air knives 28 where excess galvanized material is blown downwardly back into the bath 14. The sheet 36, as it emerges from the air knives 28 has the desired accumulation of galvanized material on the surfaces.

As is appreciated, with normal roughened surfaces to be galvanized, edge treatment is required by edge treatment devices 38 and 40. The edge treatment devices minimize turbulence at the edges 42 and 44 to control build-up of galvanized material on the shoulder and edges of the sheet. Without the edge treatment considerably thicker layers of galvanized material will adhere to the shoulders and edges thereby devaluing the quality of the galvanized sheet because of the variation of thickness of galvanized material. It is understood that the reference to the sheet shoulders and edges includes not only the sheet edge defined by the sheet thickness but as well the sheet surface portions slightly inwardly of the edges. Such surface portions are referred to as the shoulders of the sheet edges.

Figure 2:
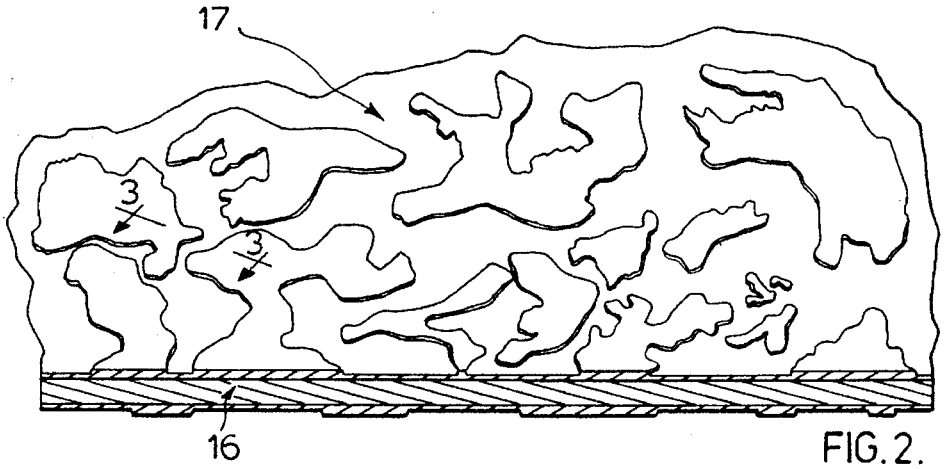
FIG. 2. (PRIOR ART)
FIG. 2 is a plan view of a roughened surface of a steel sheet to be coated with galvanized material.
Figure 3:
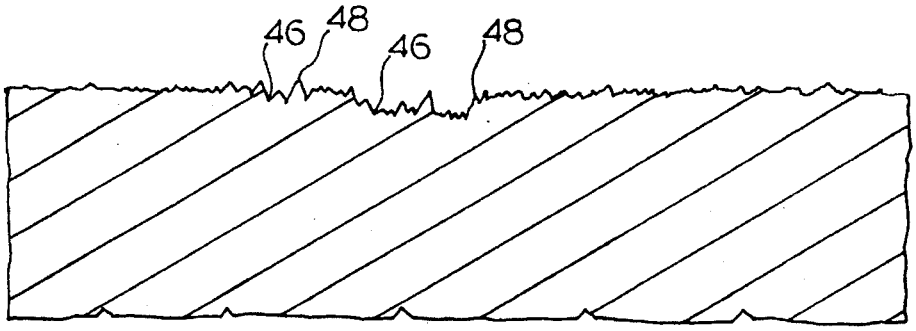
FIG. 3. (PRIOR ART)
FIG. 3 is an enlarged section along lines 3—3 of the upper surface of the roughened steel sheet of FIG. 2.

As shown in FIG. 2, a normal sheet of steel 16 has a roughened surface 17 of peaks and valleys of varying height. The peak and valleys in the surface are shown in the enlarged cross-section view of FIG. 3 where the valleys 46 are provided between ridges 48. Usually the depth of the peaks and valleys between the ridges 48 are in the range of 200 to 250 microns.

The surface roughness for the sheet 16 of FIG. 2 is acceptable in most hot dip applications where desired quantities of galvanized material on the surfaces for double sided coating is in the range of 500 g/m$^2$ or less. For example, steel sheet of the type of FIG. 2 receives or picks up a sufficient quantity of galvanized material to ensure reasonably consistent coating weights in the range of 200 to 300 g/m$^2$. Such coating weights are usually provided over a consistent thickness for the galvanized material. It has been found however that when attempting to provide considerably greater quantities of galvanized material on the roughened steel surface there can be considerable variation in quantities of material adhered to the surface of the steel sheet. For example, in attempting to achieve 600 to 700 g/m$^2$ of galvanized material on a sheet roughened, in accordance with FIG. 2, there may be an out of tolerance variation of material on the surface of the steel sheet. This out of tolerance divergence results in unacceptable material which is sold at a discount. Discounted material is very costly for the manufacturer, particularly when up to 20% of the material may be unacceptable.

In order to facilitate discussion of various aspects of the invention particularly as they apply to providing the surface pattern of this invention to only one side of a steel sheet, the quantity of surface coating may be defined either on the basis of double sided coating or single sided coating. In order to equate the quantities for double and single sided coatings the following equivalents are provided in Table 1.

TABLE I

| GALVANIZED COATED STEEL SHEET | | |
|---|---|---|
| NOMENCLATURE | DOUBLE SIDED QTY. (g/m$^2$) | SINGLE SIDED QTY. (g/m$^2$) |
| Z001 | No Minimum | No Minimum |
| Z90 | 90 | ≧30 |
| Z180 | 180 | ≧60 |
| Z275 | 275 | ≧94 |
| Z350 | 350 | ≧120 |
| Z450 | 450 | ≧154 |
| Z600 | 600 | ≧204 |
| Z700 | 700 | ≧238 |
| Z1200 | 1200 | ≧408 |
| Z1800 | 1800 | ≧612 |
| Z2000 | 2000 | MAX (1200) |

In Table I, it is apparent that the single sided weights are given as a minimum. The variation from the desired level of one-half the desired quantity for both sides is 30% of the total amount.

A variation of greater than 30% coating quantity is normally considered as unacceptable material. In addition to above Table I, the following Tables are provided for galvalume and aluminized materials.

TABLE II

| ALUMINUM-ZINC COATED STEEL SHEET (i.e. Galvalume) | | |
|---|---|---|
| | DOUBLE-SIDED QTY. (g/m$^2$) | SINGLE-SIDED QTY. (g/m$^2$) |
| AZ 150 | 150 g/m$^2$ | 52 g/m$^2$ |
| AZ 165 | 165 g/m$^2$ | 60 g/m$^2$ |
| AZ 180 | 180 g/m$^2$ | 62 g/m$^2$ |

TABLE III

| ALUMINUM COATED STEEL SHEET | | |
|---|---|---|
| | DOUBLE-SIDED QTY. (g/m$^2$) | SINGLE-SIDED QTY. (g/m$^2$) |
| T1-25 | 75 g/m$^2$ | 24 g/m$^2$ |
| T1-40 | 120 g/m$^2$ | 36 g/m$^2$ |
| T2-65 | 195 g/m$^2$ | 72 g/m$^2$ |
| T2-100 | 305 g/m$^2$ | 110 g/m$^2$ |

Figure 4:
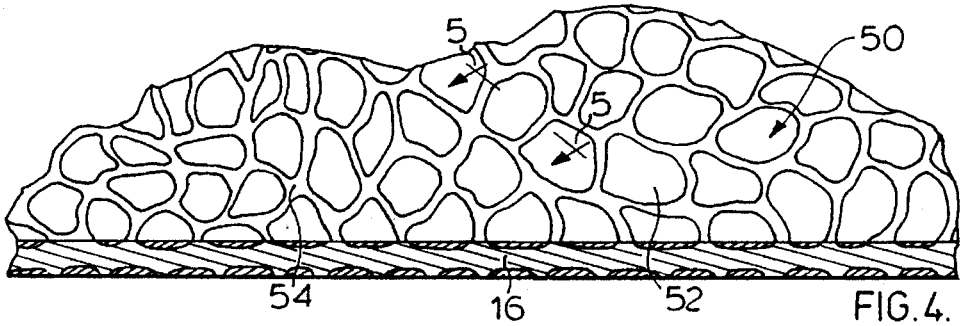
FIG. 4 is a plan view of a patterned surface in accordance with this invention ready for application of galvanized material.
Figure 5:
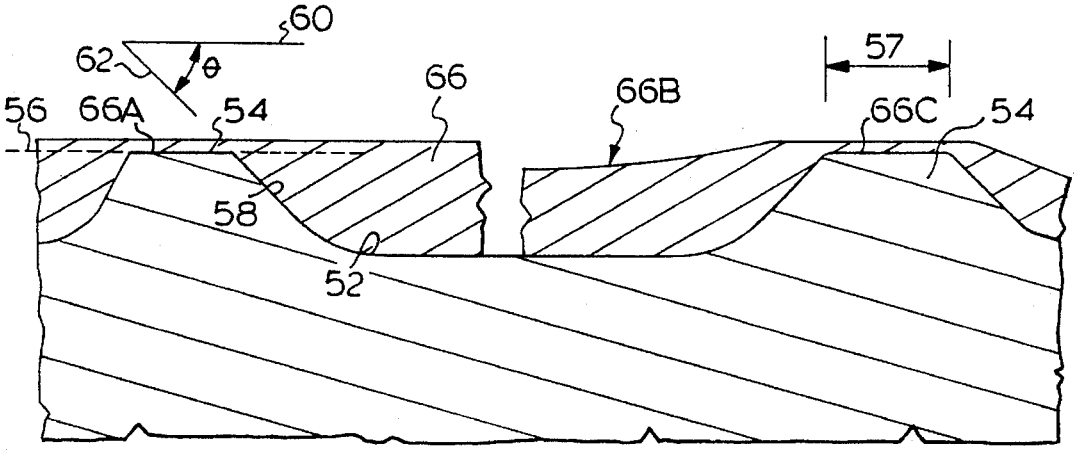
FIG. 5 is an enlarged section along lines 5—5 of the upper surface of the sheet of FIG. 4.

Applicant's have discovered that by way of a surface pattern of this invention, the quantity of galvanized material adhered to the surface can be ensured on a consistent basis even for double sided coating quantities well in excess of 600 g/m$^2$. Consistent double sided coating quantities of galvanized material have been achieved at weights ranging from 600 up to 2000 g/m$^2$ or greater. The pattern which now ensures the desired consistent quantity of galvanized coating during application of such material, provides a multitude of depressions on either or both sides of the sheet. An exemplary pattern is shown in FIG. 4 where the pattern 50 comprises a plurality of depressions 52 which are defined by a plurality of ridges 54. The upper surfaces of these ridges for each side define a plane for that side. With reference to FIG. 5, the ridges 54 define a plane identified by dashed line 56. The upper surfaces of these ridges have a surface area less than ¼ the nominal surface area of the side. In accordance with a preferred embodiment of the invention, the surface area of the ridges, for example as represented at 57, can be less than ⅒th the nominal surface area of the sheet side. The nominal surface area of the sheet side is simply determined by the width of the sheet multiplied by a representative length of the sheet. That representative length may be in the form of 0.5 m or 1 m or 2 m in order to achieve a representative sample of the pattern.

As shown in FIG. 5, each depression has a depth defined by a side wall 58 which extends into the plane 56. The side wall 58 slopes downwardly from the plane 56 at the angle θ represented by line 60 which is parallel to plane 56 and line 62 which is parallel to the slope of the side wall 58. The angle θ is preferably greater than 45°, hence providing depressions having relatively sharp side walls. The depressions have essentially flat base portions 64 adjoined by the side wall 58.

These multitude of depressions on either or both sides of the sheet pick up a sufficient quantity of galvanized material to provide the desired consistent quantity of galvanized material when solidified and adhered to the side of the steel sheet.

The pattern in accordance with this invention may be formed in the steel sheet by a variety of techniques. Commonly, the steel sheet is roughened by finishing rolls in the steel rolling process. Similarly, the pattern of FIG. 4, in accordance with an embodiment of this invention, may be provided on one or both sides of the sheet. The pattern as shown in FIG. 4 resembles a honeycomb pattern. In order to apply the honeycomb pattern to the surface of the sheet, finishing work rolls are required which have the negative of the pattern desired in the sheet. Depending upon whether both or one side of the sheet is to be so patterned a work roll is developed with the reverse image of the pattern. This image may be machined in the roller surface or in accordance with standard acid etching techniques, the pattern may be etched in the surface of the roll by surrounding the roll with a sleeve which permits the flow of acid therethrough but only exposes portions of the roll which define by etching the reverse image of the pattern of FIG. 4. Hence, the roll when finished has a surface appearance of a multitude of lands defined by crevices which correspond to the shape of the continuous ridges 54 of FIG. 4. Such acid etching service may be provided by Roehlen Industries under the trade-mark MOLD-TECH.

In the normal preparation of the steel strip, it is progressively reduced in thickness up to a point near the final desired thickness. The last cold reduction pass in the cold rolling mill process is carried out with the etched finishing work roll or rolls to imprint on either or both sides of the sheet the desired pattern.

In view of the inherent flexibility of the acid etching process, it is appreciated that a variety of surface patterns may be provided which have the characteristic of a multitude of depressions being provided in the sheet. The depressions are defined by a plurality of ridges, where the ridges and depressions fall within the parameters of this invention. The ridges as shown in FIG. 4 are irregular in pattern and may be continuous or interrupted. The pattern as shown in FIG. 4 has a continuous pattern of ridges 54 where all ridges 54 are interconnected. It is appreciated however that there may be interruptions in the ridges where such interruptions break the continuous nature of the ridges 54 of FIG. 4. Such interruptions are not sufficient in number nor in shape to detract in any significant way from the ability of the pattern to pick up on a consistent basis, the desired quantity of galvanized material. Furthermore, it is understood that the ridges in being preferably flat, are all essentially in the same plane. Such planar aspect of the ridges is, of course, determined by accuracy achieved by the acid etching process in making the roll surface and by the steel rolling process.

It has also been found that providing a multitude of depressions in the sheet, the work roll then has a corresponding multitude of lands. This significantly extends the life of the work rolls compared to prior art form of work rolls which induced a toughened surface in the steel sheet, such as shown in FIG. 2. The work rolls which introduce the jagged surface pattern are usually formed by shot blasting the surface of the work roll to achieve a surface which is a combination of jagged ridges and sharp valleys. By virtue of the sharp jagged edges on the work rolls which protrude into the surface of the steel sheet, the work rolls have limited life before they must be rejuvenated for subsequent re-use in roughening the steel sheet.

Although the function of the roughened surface pattern in picking up coating material has been with respect to galvanized material, it is understood that the pattern also functions in picking up other protective surface coatings such as galvalume and aluminized materials. As already noted, galvanize materials include mostly zinc and some aluminum. Galvalume includes a majority of aluminum (approx. 55% by weight) with a minor amount of zinc (approx. 43% by weight) and the remaining 2% being known additives. The aluminized material is predominantly aluminum (>98% by weight). The aluminized material provides a protective coating by forming a tough aluminum oxide coating which is highly resistant to corrosive attack in normal environments. The galvalume material provides protection by the combination of cathodic protection and aluminum oxide protection. As to the bath temperatures for these alternate protective materials, galvalume is provided in a bath at a temperature in the range of 900° to 925° F. and aluminize material is normally at a bath temperature of approximately 1100° F.

The surface patterns, in accordance with several aspects of the invention are then capable of picking up double sided quantities of galvanized or other protective materials in the range of 600 to 2000 g/m$^2$ on a consistent basis. The consistency in the amount of material is assured by the use of the air knives 28 of FIG. 1 to remove excess galvanized material from the surface to leave behind the desired quantity. Preferred ranges for the galvanized material is from 800 to 1800 g/m$^2$ and particularly the preferred ranges are from 800 to 1200 g/m$^2$. It is appreciated that the pattern used in accordance with this invention need not only apply to the heavier quantities of galvanized coating but could as well be used for lighter coating quantities less than 600 g/m$^2$.

Depending upon the amount of galvanized material to be picked up by the surface, the average depth of the depressions may range approximately from 500 to 700 inches (0.005" to 0.007"). It is apparent that the greater the quantity of material to be picked up the greater the depth of the depressions and as well the greater number of depressions. Hence, a lower surface area for the upper surfaces of the ridges falls in the range of approximately ⅒ the nominal surface area of the sheet side.

It is appreciated that either or both sides of the sheet may be treated to have the honeycomb pattern. In the event that only one side is provided with the honeycomb pattern, the other side may be smooth or roughened to the extent shown in FIG. 2. This variation in sheet coating is for purposes of providing thicker coating of galvanized material on one side of the sheet than the other and also providing a smoother finish for the galvanized material on one side versus the pattern side. Based on the information provided in Tables I, II and III, the preferred ranges for the various protective coatings are as follows:

Zinc Coated from 30 $g/m^2$/side to 1200 $g/m^2$/side

Aluminum-Zinc Coated from 40 $g/m^2$/side to 350 $g/m^2$/side

Aluminum Coated from 20 $g/m^2$/side to 600 $g/m^2$/side

The more preferred ranges are:

Zinc Coated from 220 $g/m^2$/side to 1000 $g/m^2$/side

Aluminum-Zinc Coated from 60 $g/m^2$/side to 300 $g/m^2$/side

Aluminum Coated from 110 $g/m^2$/side to 500 $g/m^2$ side, and the most preferred ranges are:

Zinc Coated from 400 $g/m^2$/side to 800 $g/m^2$/side

Aluminum-Zinc Coated from 115 $g/m^2$/side to 340 $g/m^2$/side

Aluminum Coated from 200 $g/m^2$/side to 400 $g/m^2$ side,

Depending upon the use to which the steel sheet is put it is understood that the thicker galvanized material is normally exposed to the corrosive environment which may as well be abrasive and where the thinner coating is exposed to the less corrosive environment. For example, with galvanized culvert structures, the thicker galvanized material may be provided on the inside of the culvert and the thinner galvanized material provided on the outside. The thicker galvanize coating for culvert interior not only extends the life of cathodic protection for the steel pipe, but as well, provides additional resistance to abrasion. Preferably, in order to reduce costs in producing the galvanized culvert, the patterned surface is provided on the side of the sheet which becomes the interior of the culvert and the roughened surface becomes the exterior of the culvert. There will be, however, situations where a thick coating of galvanized material is desired on both sides of the culvert, hence, both sides of the sheet carry the honeycomb pattern to provide the thicker quantities of galvanized material on both sides of the culvert.

It is also appreciated that the galvanized material may be used on a variety of other items which require protection such as guardrails, retaining walls, box culverts, building sheet and the like.

Another additional benefit in the use of the honeycomb pattern on either or both sides of the sheet is that shoulder and edge build up of material is minimized. When the honeycomb pattern such as that of FIG. 4 is applied to both sides of the sheet there is no need to use the edge control devices 38 and 40 of FIG. 1. Surprisingly, it has been found that the edges pick up the same amount of galvanized material as the sides so that the edges do not tend to thicken relative to the thickness of the central portion of the sheet. This is a significant cost saving not only from a processing standpoint but as well avoiding or minimizing reject material to ensure on a consistent basis that the product has the desired quantity of galvanized coating and as well the desired edge profile.

Another advantage which flows from the use of a pattern in accordance with this invention is that the ridges 54, as shown in the enlarged view of FIG. 5 are of steel which is considerably harder than the zinc galvanizing material 66. A freshly coated sheet, as shown in FIG. 5 has galvanizing material 66 in the depression 52 where the thickest amount of galvanized material exists in the depression 52 leaving a significant thinner coating of galvanized material **66*a* above the ridges 54. Furthermore, it is appreciated, depending upon the amount of galvanized material provided on the surface of the steel sheet the galvanized material may dip into the depression 52 to the extent shown at 66*b* which has a thickness below the plane defined by the ridges 54. Similarly, with the lesser quantities of galvanized material applied to the steel sheet a thin coating 66*c* of galvanized material remains on the ridge 54**.

A further advantage with the pattern of FIG. 5 is that the harder steel ridges can serve over extended periods to protect the galvanized material which remains in the depression 52. It is understood for example that if the honeycomb pattern coated sheet is used on the inside of a culvert, water flowing through the culvert will tend to abrade the thinner coating **66*a* and 66*c* from the ridges 54. Such erosion exposes the steel ridges 54. However, the presence of the galvanized material within the depressions 52 continue to cathodically protect the exposed steel so that the zinc oxidizes in preference to the exposed steel. The water continues to abrade the inner surface of the culvert, however, the harder ridges 54 delay the rate at which the water with grit removes the galvanized material provided within the depressions 52. This delay is thought to be due to the harder steel ridges deflecting the abrasive material away from the galvanized material held in the depressions 52**. In this manner, extended life for the culvert is achieved where, as already noted, zinc which is within 2.5 to 3 mm of exposed steel continues to provide cathodic protection. As a result, the exposed ridges on the inside of the culvert do not rust until the zinc has been completely inactivated by conversion to zinc oxide.

Significant advantages which flow from the pattern surface in accordance with this invention is the ability to control zinc coating weight with amounts far in excess of those achieved by the normal roughened surfaces such as shown in FIG. 2. The uniformity of the zinc coating is superior particularly at the edges/shoulders of the sheet because of the elimination of edge build-up due to the pattern surface. The elimination of such edge build-up in the coils reduces shape distortion in the coated strip and reduces handling problems during subsequent forming operations for the sheet. A further advantage is in the shape of the pattern eventually provides exposed steel ridges which act to protect the galvanized material retained in the depressions from abrasion and thereby extend the life of the galvanized material in a harsh abrasive environment. Also, the ability to preferentially apply the surface pattern to one side of the strip versus the other allows for building-up a large quantity of galvanized material on one side of the sheet versus a considerably lighter quantity of galvanized material on the other. For example, in providing galvanized steel sheet for use in forming culverts and the like. The thicker coating may only need be applied to the side of the sheet which becomes culvert inside, whereas the outside can carry a significantly lighter coating because it is exposed to a less corrosive environment, hence, significantly reducing the costs of manufacture of the sheet for use in forming culverts.

Although preferred embodiments of the invention are described herein in detail, it will be understood by those skilled in the art that variations may be made thereto without departing from the spirit of the invention or the scope of the appended claims.

We claim:

1. In a hot dip coated steel sheet product having a protective coating layer of a protective metallic coating material selected from the group consisting of galvanized material, galvalume material and aluminized material, said protective material being applied over its entire surface, said steel sheet being roughened on at least one side prior to hot dip application of protective material thereto, said protective material during said hot dip application reaction with said steel sheet to form a steel alloy which adheres said layer of protective material to said steel sheet, the improvement being characterized by said roughened steel surface having a pattern which ensures consistent quantity of said protective coating during application of said protective material, said pattern providing on said side a multitude of depressions defined by plurality of ridges, the upper surfaces of essentially all of said ridges for said side defining a plane for said side, said upper surfaces of aid ridges having a surface are less than one quarter the nominal surface area of said side, each depression having a depth defined by a sidewall extending into said plane of said side, said sidewall sloping inwardly of said side plane at an angle greater than 45°, said depressions being on average approximately 500 to 700 microns deep, said multitude of depressions on said side having picked up a sufficient quantity of said protective material to provide a consistent quantity of said protective material when solidified and adhered to said side steel sheet.

2. In a steel sheet product of claim 1, said surface pattern having picked up a quantity of galvanized material in the range of 30 to 1200 g/m$^2$.

3. In a steel sheet product of claim 2, said quantity range for galvanize material ranging from 220 to 1000 g/m$^2$.

4. In a steel sheet product of claim 3, said quantity range for galvanize material ranging from 400 to 800 g/m$^2$.

5. In a steel sheet product of claim 2, said plurality of ridges being interconnected to form continuous ridges, said depressions thereby having continuous sidewalls.

6. In a steel sheet product of claim 5 said depressions being dish-shaped in cross-section with steep sidewalls at an angle greater than 45° from said side plane, each of said dish-shaped depressions having substantially flat base portions.

7. In a steel sheet product of claim 6, said pattern being substantially honeycomb in appearance.

8. In a steel sheet product of claim 5, said upper surfaces of said ridges having a surface area of about 1/10 the nominal surface area of said sheet side.

9. In a steel sheet product of claim 2, said sheet being characterized by having both sides thereof provided with said pattern to maximize thereby the quantity provided on both sides of said sheet.

10. In a steel sheet product of claim 1, said surface pattern having picked up a quantity of galvalume material in the range of 40 to 350 g/m$^2$.

11. In a steel sheet product of claim 10, said range for galvalume material ranging from 60 to 300 g/m$^2$.

12. In a steel sheet product of claim 10, said range of galvalume material ranging from 115 g/m$^2$ to 340 g/m$^2$.

13. In a steel product of claim 1, said surface pattern having picked up a quantity of aluminized material in the range of 20 to 600 g/m$^2$.

14. In a steel sheet product of claim 13, said range of aluminized material ranging from 110 to 500 g/m$^2$.

15. In a steel sheet product of claim 14, said range of aluminized material ranging from 200 g/m$^2$ to 400 g/m$^2$.

16. A product formed from said hot dip coated sheet of claim 1, wherein only one side of said sheet has said pattern, the other side of said sheet having a non-patterned surface, said patterned side being on a surface of said product which is exposed to highest corrosion/abrasion, said non-patterned side being on a surface exposed to lowest corrosion/abrasion, said patterned surface having an increased quantity of protective material to withstand said highest corrosion/abrasion.

17. a product according to claim 16 comprising a culvert.

18. A product according to claim 16 comprising a guardrail.

19. A product according to claim 16 comprising retaining walls.

20. A product according to claim 16 comprising box culverts.

21. A product according to claim 16 comprising a building sheet.

22. A steel sheet having a surface pattern on at least one side for ensuring a consistent quantity of protective metallic coating material by hot dip application of said protective material, said pattern providing on said side a multitude of depressions defined by plurality of ridges, the upper surfaces of essentially all of said ridges for said side defining a plane for said sheet side, said ridges having a surface area less than one quarter the nominal surface area of said side, each depression having a depth defined by a sidewall extending into said plane of said side, said sidewall sloping inwardly of said side plane at an angle greater than 45°, said depressions being on average approximately 500 to 700 microns deep, said multitude of depression on said side picking up a sufficient quantity of said protective material to provide said consistent quantity of said protective material when solidified and adhered to said side of said steel sheet.

23. A steel sheet of claim 22 wherein said surface pattern picks up a quantity of metallic protective material in the range of 30 to 1200 g/m$^2$.

24. A steel sheet of claim 23, said plurality of ridges being interconnected to form continuous ridges, said depressions thereby having continuous sidewalls.

25. A steel sheet of claim 24 wherein said depressions are dish-shaped in cross-section with steep sidewalls at an angle greater than 45° from said side plane, each of said dish-shaped depressions having a substantially flat base portion.

26. A steel sheet of claim 25 wherein said pattern is substantially honeycomb in appearance.

27. A steel sheet of claim 24 wherein said upper surfaces of said ridges are flat.

28. A steel sheet of claim 18 wherein said upper surfaces of said ridges have a surface area of about 1/10 the nominal surface area of said sheet side.

29. A steel sheet of claim 23, wherein said sheet is characterized by having both sides thereof provided with said pattern to maximize thereby quantity of protective material provided on both sides of said sheet.

* * * * *